US005826970A

United States Patent [19]

Keller et al.

[11] Patent Number: 5,826,970

[45] Date of Patent: Oct. 27, 1998

[54] LIGHT TRANSMISSIVE TRIM PLATE FOR RECESSED LIGHTING FIXTURE

[75] Inventors: Bruce A. Keller, Biscayne Park, Fla.; Stephen L. Smoak, Marietta, Ga.; Ivano Ferro, Resana, Italy

[73] Assignee: Effetre U.S.A., North Miami, Fla.

[21] Appl. No.: 768,899

[22] Filed: Dec. 17, 1996

[51] Int. Cl.[6] ..... F21S 13/02

[52] U.S. Cl. ..... 362/147; 362/364; 362/365

[58] Field of Search ..... 362/147, 364, 362/365, 366, 404, 408, 457

[56] References Cited

U.S. PATENT DOCUMENTS

| | | | |
|---|---|---|---|
| 3,158,329 | 11/1964 | Wince | 362/365 |
| 3,286,090 | 11/1966 | Brown | 362/366 |
| 3,302,019 | 1/1967 | Menzin | 240/147 |
| 4,835,667 | 5/1989 | Wolfe | 362/276 |
| 4,922,393 | 5/1990 | McNair | 362/225 |
| 5,083,248 | 1/1992 | Troy | 362/147 |
| 5,309,342 | 5/1994 | Heinen, Sr. | 362/364 |
| 5,373,431 | 12/1994 | Hayman et al. | 362/364 |
| 5,440,471 | 8/1995 | Zadeh | 362/364 |

*Primary Examiner*—Y My Quach
*Attorney, Agent, or Firm*—Kennedy, Davis & Kennedy

[57] ABSTRACT

A light-transmissive trim plate and mounting apparatus for being received in a recessed lighting fixture installed in a space over a ceiling, in which a light bulb, being operated for light, communicates light through the trim plate for providing an ornamental illuminative effect around a perimeter of the opening for the recessed lighting fixture. The trim plate comprises a translucent light-transmissive trim ring defined by a cup having a first open end and a second open end with a flange extending laterally around the first end. The trim ring defines a perimeter ring conforming in shape to an opening of a recessed lighting fixture. A support engages the trim ring in the recessed lighting fixture. The trim ring covers a gap between the recessed lighting fixture and the ceiling while providing an ornamental illuminative appearance during operation of the light bulb.

6 Claims, 2 Drawing Sheets

LIGHT TRANSMISSIVE TRIM PLATE FOR RECESSED LIGHTING FIXTURE

TECHNICAL FIELD

The present invention relates to recessed lighting fixtures. More particularly, the present invention relates to decorative trim plates that provide an illuminative ornamental appearance around the perimeters of recessed lighting fixtures.

BACKGROUND OF THE INVENTION

Recessed lighting fixtures are often used in restaurants, offices and homes to provide light for rooms. Recessed lighting fixtures typically mount a space over a ceiling so that the fixtures are not readily seen in a room. The fixture has an open end and mounts over an opening in the ceiling. Light passes from the recessed fixture into the room to not only brighten the room but to provide artistic qualities to a lighting scheme.

The recessed lighting fixture typically comprises a cylindrical housing which is received through an opening in a ceiling into the space over the ceiling. A reflector is received in the housing. A socket or lamp holder typically mounts to an upper end of the housing for receiving a light bulb which extends through an opening in the reflector. The interior surface of the reflector directs light from the light bulb through the open end of the housing into the room below the ceiling. The socket conventionally includes electrical conductors which communicate with the supply of electrical current, preferably through a conventional junction box in the space over the ceiling.

The housing for the recessed lighting fixture often is made of aluminum or other sheet metal. A mounting flange extends outwardly of the open end of the housing. However the mounting flange is not ornamentally attractive. Further, there often is a gap between the opening in the ceiling and the sidewall of the housing. Accordingly, a trim plate is typically attached to the housing in order to provide an ornamentally attractive appearance to the light fixture. The trim plate covers a perimeter portion of the open end of the housing and extends outwardly therefrom in order to cover the opening in the ceiling and the lower portion of the housing of the recessed lighting fixture. Some trim plates define a frame that holds a flat glass plate which covers the open end of the housing. The glass plate may be transparent or translucent.

Known trim plates typically are pressed or stamped from metal and are provided with a brushed or finished appearance. During operation of the recessed lighting fixture, light is directed by the reflector outwardly of the fixture through the open end into the room below. While satisfactory for providing lighting to the room below, the ornamental effect is limited to the column of light directed by the reflector out of the recessed lighting fixture. This results in a relatively dark perimeter portion around the opening of the recessed lighting fixture. While the trim plates are satisfactory for the intended purpose of covering the open space between the reflector housing and the opening in the ceiling, there remains a need in the art for illuminating the perimeter portion of the recessed lighting fixture adjacent the ceiling. One known trim plate resolves this problem by providing a plurality of apertures through which light beams emit from the trim plate of the lighting fixture. While satisfactory for illuminating the perimeter portion, there remains a need for a more uniform, softer lighting effect around the perimeter portion of recessed lighting fixtures. It is to such that the present invention is directed.

SUMMARY OF THE INVENTION

The present invention provides an improved trim plate and mounting apparatus for being received in a recessed lighting fixture for providing a finished appearance to the fixture mounted in a ceiling and to provide a subdued illuminative ornamental effect around the perimeter portion of the recessed lighting fixture adjacent the ceiling. The present invention provides a light transmissive trim plate and mounting apparatus which is received by a recessed lighting fixture installed in a space over a ceiling. The recessed lighting fixture has a light bulb which when operated, communicates light through the trim plate for an illuminative ornamental appearance around a perimeter of the recessed lighting fixture. The light transmissive trim plate comprises a translucent trim ring which is preferably defined by a frustroconical cup having open ends and a flange extending laterally around one of the ends, which flange defines a perimeter ring conforming in shape to an open end of a recessed lighting fixture. A mounting apparatus connects to the light transmissive trim ring to the housing of the recessed light fixture. In a preferred embodiment, the mounting apparatus comprises a frustroconical reflective insert having a lower open end and a partially closed upper end which defines an opening configured for engagement to a light socket within the recessed lighting fixture. A lower portion of the reflective insert defines a lip that is flared outwardly to define a surface for supporting an inner edge portion of the light transmissive trim plate. A pair of elongated spring members attach at first ends to the partially closed end of the reflective insert and extend in outwardly opposite directions. The reflective insert is received within the light transmissive trim plate and the spring members are thereafter engaged to the partially closed end. The reflective insert is then slidingly received within the recessed lighting fixture mounted in a space over a ceiling. The support surface of the flared lip thereby comes into engagement with the inner edge portion of the trim plate, whereby the insert supports the trim plate on the flared support surface. The spring members flexibly flare outwardly and bear forcibly against an inner wall of the lighting fixture to hold the insert, and thereby the trim plate, in position relative the lighting fixture and the ceiling.

DETAILED DESCRIPTION OF THE PREFERRED EMBODIMENTS

Figure 1:
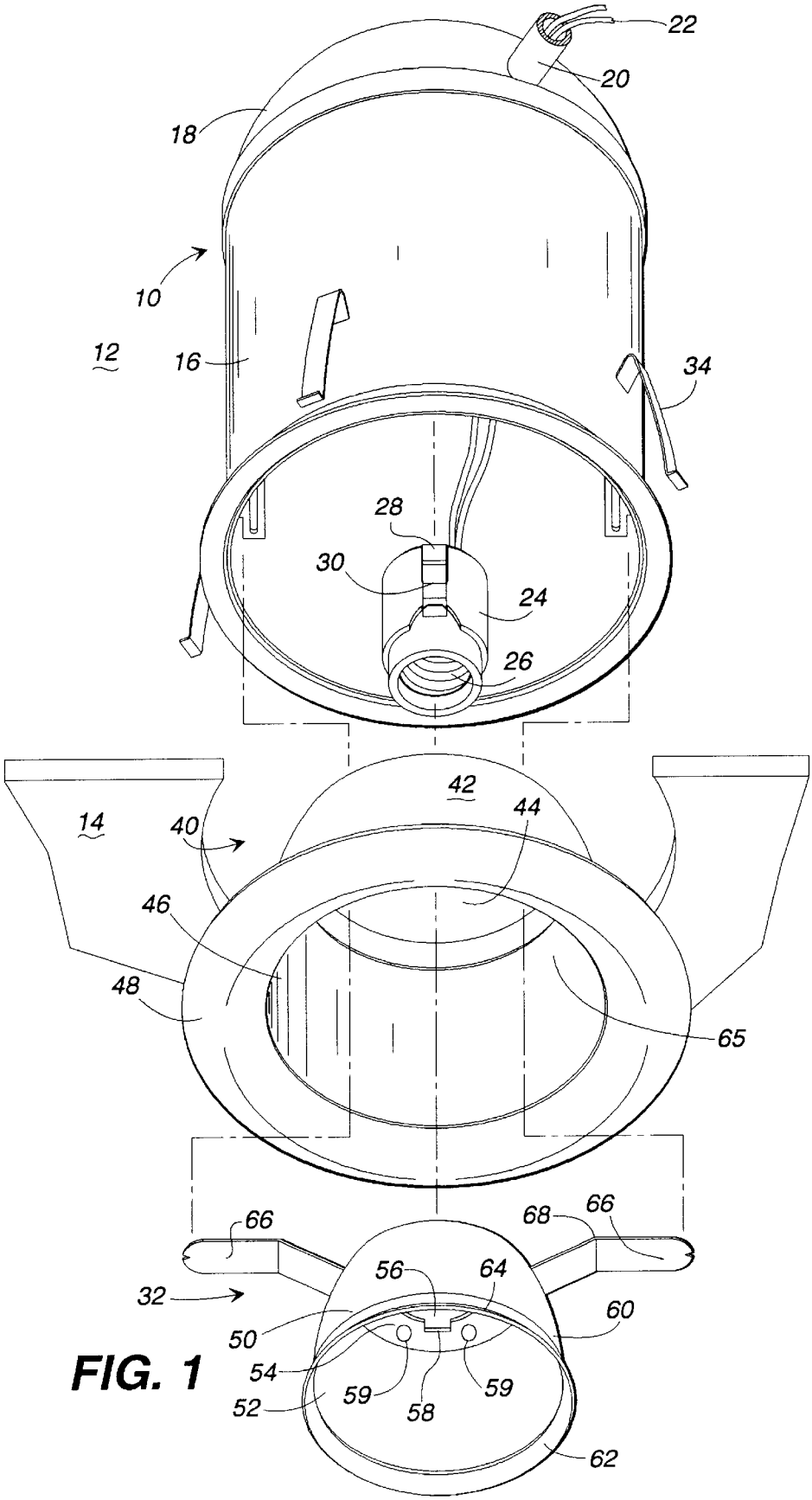
FIG. 1 is a perspective exploded view of a recessed lighting fixture and light transmissive trim plate of the present invention for installation in a space above a ceiling.

Referring now in more detail to the drawings, in which like numerals indicate like parts throughout the several views, FIG. 1 is a perspective exploded view of a recessed lighting fixture 10 for installation in a space designated 12 above a ceiling 14 and having a trim plate 40 as discussed below. The light fixture 10 includes a housing 16 having a closed end 18. In the illustrated embodiment, the housing 16 is a cylindrical open-ended tube. The closed end 18 is a dome-shaped cap which is secured to an upper end of the cylindrical housing 16. A conduit 20 extends outwardly of the dome 18 through which electrical conductors 22 pass for communicating electricity from a supply of electrical current. The electrical conductors 22 connect to a light socket 24. In the illustrated embodiment, the light socket 24 is a ceramic base having a metal threaded cup 26 for receiving a threaded base of a conventional light bulb. A clip 28 connects to the base of the light socket 24 and has outwardly projecting arms 30 on opposing sides of the light socket 24 for matingly engaging a reflector insert 32, as discussed below.

In the illustrated embodiment, four support arms 34 extend outwardly from the side wall of the cylindrical housing 16. The support arms 34 support the recessed lighting fixture 10 in the opening in the ceiling 14, as discussed below.

The lighting fixture 10 includes an ornamental trim ring or plate 40 according to the present invention. The trim plate 40 in the illustrated embodiment is defined by a frustroconical cup 42 having an upper open end 44 and a lower open end 46. The upper end 44 is narrower than the lower open end 46. A flange 48 extends laterally from a lower portion of the frustroconical cup 46. The trim plate 40 is preferably manufactured using a poured molding process using a translucent light transmissive materials, such as glass. In this process, molten glass is placed in a centrifugal mold which spins to move the glass uniformly to the edges of the mold. The surface of the trim plate 40 may thereafter be treated to provide a defusing effect to the light communicated through the plate. The glass may be tinted to provide a color effect to the illlumination during operation of the fixture 10.

Figure 2:
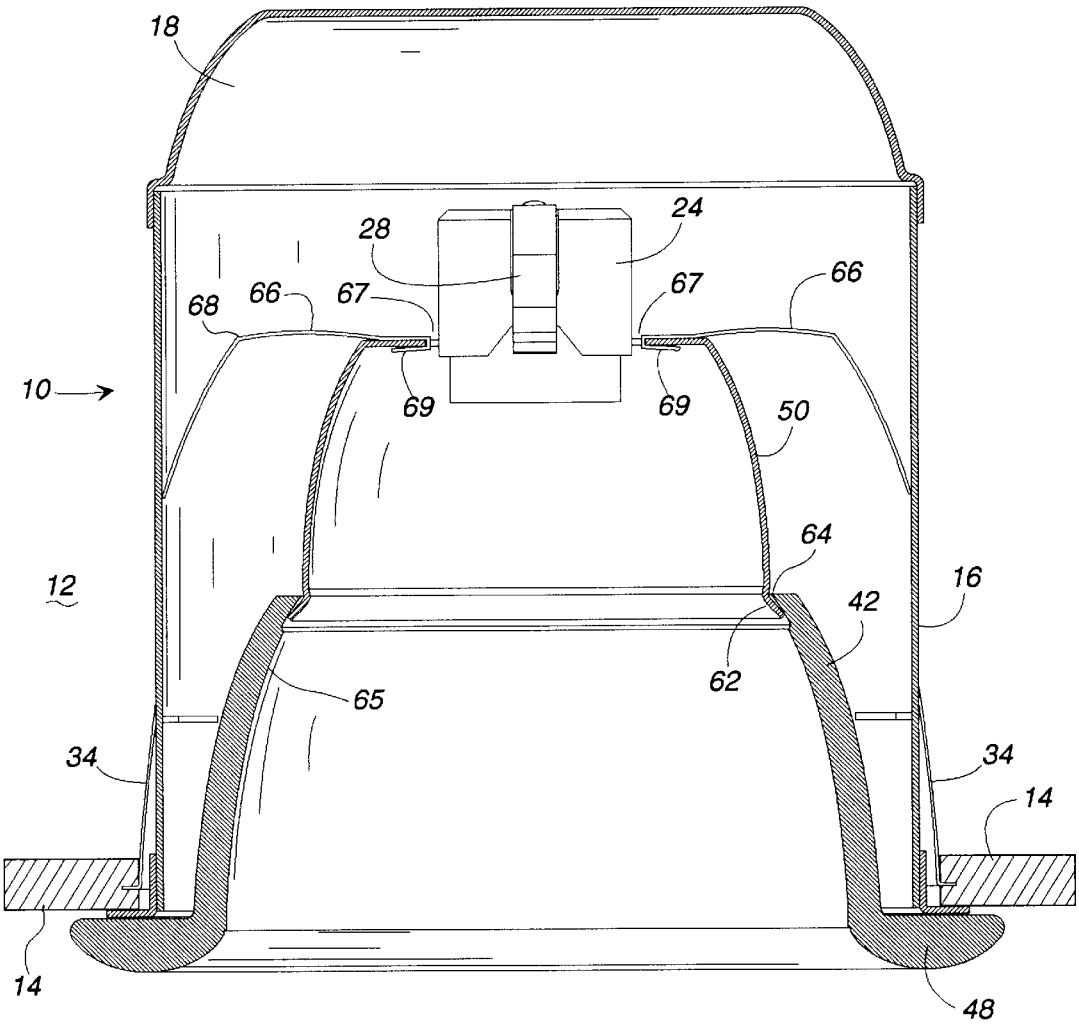
FIG. 2 is a cross-sectional view of the recessed lighting fixture and trim plate illustrated in FIG. 1.

In the illustrated embodiment, the trim plate 40 defines an annular ring. The translucent light transmissive trim plate 40 is supported in the housing by the reflector insert 32. The reflector insert 32 comprises a frustoconical cup 50 having a lower open 52 and a partially closed upper end 54. The partially closed end 54 defines an opening 56 configured for engagement to the light socket 24. In particular, the opening 56 includes notches 58 for receiving the arms 30 of the clip 28 attached to the light socket 24. The end 54 further defines a plurality of holes 59 for communicating heat from the light bulb into upper portions of the housing 16. A lower portion 60 of the cup 50 defines a flared lip 62 that extends outwardly. The flared lip 62 defines an exterior surface 64 for supporting an interior portion 65 of the light transmissive trim plate 40 adjacent the upper end 44. A pair of spring members 66 connect at first ends 67 to the partially closed end 54. As best shown in FIG. 2, the end 67 of the spring member 66 folds over to define a clip 69 which is slidingly engaged to the partially closed end 54 of the reflector insert 32. The spring members 66 extend in outwardly opposite directions. In the illustrated embodiment each spring member 66 includes an elbow 68 medial the ends of the members which bends to facilitate engagement of the member with the housing 16. The members 66 extend outwardly of the reflector cup 50 a greater distance than the interior diameter of the recessed lighting housing 16, for a purpose discussed below.

The trim plate 40 and the reflector insert 32 are assembled to define the light transmissive trim plate and mounting apparatus for being received in the housing 16 of the recessed lighting fixture 10, as illustrated in FIG. 2. The reflector insert 32 is slidingly received within the interior of the trim plate 40 through the open end 44. The reflector insert 32 thereby extends through and outwardly of the upper open end 44 of the trim plate 40. The spring members 66 are then attached to the partially closed end 54. In the illustrated embodiment, the first end 67 of the member 66 slidingly attaches with the clip portion 69 to the partially closed end 54. In an alternate embodiment (not illustrated), the members 66 are riveted at the first ends 67 to the partially closed end 54. The spring members 66 preferably extend outwardly of the reflector insert 32 in opposing directions. The spring members 66 define arms that restrict the reflector insert 32 from detaching from the trim plate 40 because the spring members extend outwardly of the trim plate 40 and are restricted from passing through the open end 44. In an alternate embodiment (not illustrated), a pair of bores are drilled in opposing acurate sections of the interior portion 65 of the trim plate 40. Spring wires define clips which engage the bores and connect to the housing 16, for supporting the trim plate 40 in the recessed light fixture 10.

The recessed lighting fixture 10 is first installed in the space 12 over the ceiling 14, as illustrated in FIG. 2. The housing 16 passes upwardly through the opening in the ceiling 14. The support arms 34 bear outwardly from the exterior of the housing 16 against the edges of the opening of the ceiling 14. Other support apparatus (not illustrated) further supports the recessed lighting fixture 10 in the space 12. For example, the other support devices may include an arm which mounts to a ceiling joist or other rigid structure for securing the recessed lighting fixture 10 in position in the space 12. Similarly, an electrical junction box receives the electrical conductors 22 for connecting the lighting fixture 10 to a source of electrical current.

The light socket 24 extends downwardly in the housing 16. The reflector insert 32 is extended upwardly through the open end 44 of the trim plate 40. This brings the exterior surface 64 of the insert 32 into contact with the interior surface portion 65 of the cup 42 of the trim plate 40. The light socket 24 is then engaged to the partially closed end 54 of the reflector insert. This is accomplished in the illustrated embodiment by engaging the arms 30 of the clips 28 to the notches 58 in the end 54. The assembled trim plate 40 and reflector insert 32 are thereafter positioned in the housing 16 of the light fixture 10. This is accomplished by pushing the assembly of the trim plate 40 and the reflector insert 32 upwardly into the interior of the housing 16. The trim plate 40 hangs on the exterior support 64 below the reflector insert 32 as the reflector insert is pushed into the housing 16. The spring members 66 bear forcibly against the interior wall of the housing 16, as illustrated in FIG. 2, while bending at the elbows 68. The reflector insert 32 is pushed upwardly into the housing 16 until the flange 48 of the trim plate 40 contacts the ceiling 14 around the opening.

Thereafter, a light bulb is threadingly received in the cup 26 of the light socket 24, and the light is operated for illuminating the room below the ceiling 14. During operation of the light, light is directed by the reflector insert 32 through the translucent trim plate 40 and outwardly of the flange 48, thereby providing an illuminative ornamental effect around the perimeter of the recessed lighting fixture 10. The trim plate is removed from the housing 16 by pulling the trim plate outwardly of the housing 16. The spring members 66 snap upwardly and then slidingly move along the wall of the housing 16, until the trim plate 40 and reflector insert 32 are free of the housing 16. The present invention accordingly provides a light-transmissive trim ring and support for use with recessed lighting fixtures installed over ceilings. The present invention is readily installed as a retrofit feature in existing recessed lighting fixtures, to create an ornamental lighting effect for rooms, restaurants, hallways, and the like.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departing from the spirit of the invention as described in the following appended claims.

What is claimed is:

1. A light-transmissive trim plate and mounting apparatus for being received in a recessed lighting fixture installed in a space over a ceiling and having a light bulb which being operated for light communicates light through the trim plate for providing an ornamental illuminative effect around a perimeter of an opening in the ceiling for the recessed lighting fixture, comprising:

a translucent light-transmissive trim plate defined by a frustroconical cup having a first open end and a second open end with a flange extending laterally around the first open end and defining a perimeter ring conforming in shape to an opening of a recessed lighting fixture; and means for supporting said trim plate in said recessed lighting fixture, whereby said trim ring, being engaged to said recessed lighting fixture with said frustroconical cup extending partially into said lighting fixture, covers a gap between said recessed lighting fixture and said ceiling while receiving light from the light bulb through the cup thereby providing an ornamental illuminative appearance around the perimeter of the opening in the ceiling during operation of the fixture.

2. The light-transmissive trim plate as recited in claim 1, wherein support means comprises:

a frustroconical reflector insert having a lower open end and a partially closed upper end that defines an opening configured for receiving a base portion of the light bulb therethrough, a lower portion of the reflector insert defining a lip that is flared outwardly to define a surface for supporting an interior portion of the frustroconical cup of the trim plate; and a pair of elongated spring members attached at first ends to the partially closed upper end of the reflector insert and extending in outwardly opposite directions, whereby the reflector insert, being received within the trim plate and the spring members being engaged to the partially closed end of the reflector insert, is slidingly received within a recessed lighting fixture mounted in the space over the ceiling, the spring members flexibly bearing outwardly against an inner wall of the lighting fixture to hold the trim plate through the reflector insert in position relative to the lighting fixture.

3. The light-transmissive trim plate as recited in claim 2, wherein said partially closed upper end is configured for engaging a light socket for receiving the light bulb.

4. A light-transmissive trim plate and mounting apparatus for being received in a recessed lighting fixture installed in a space over a ceiling and having a light bulb which being operated for light communicates light through the trim plate for providing an ornamental illuminative effect around a perimeter of an opening in the ceiling for the recessed lighting fixture, comprising:

a translucent light-transmissive trim plate defined by a frustroconical cup having a first open end and a second open end with a flange extending laterally around the first open end and defining a perimeter ring conforming in shape to an opening of a recessed lighting fixture; and a frustroconical reflector insert having an open lower end and a partially closed upper end that defines an opening configured for receiving a base portion of the light bulb therethrough, a lower portion of the reflector insert defining a lip that is flared outwardly to define a surface for supporting an interior portion of the frustroconical cup of the trim plate; and means for supporting the reflector insert and trim plate within the recessed lighting fixture mounted in the space over the ceiling, whereby said trim ring, being engaged to said recessed lighting fixture with said frustroconical cup extending partially into said lighting fixture, covers a gap between said recessed lighting fixture and said ceiling while receiving light from the light bulb thereby providing an ornamental illuminative appearance around the perimeter of the opening in the ceiling during operation of the fixture.

5. The light-transmissive trim plate as recited in claim 4, wherein the support means comprises a pair of elongated spring members attached at first ends to the partially closed end of the reflector insert and extending in outwardly opposite directions, whereby the reflector insert, being received within the trim plate and the spring members being engaged to the partially closed end of the reflector insert, is slidingly received within the recessed lighting fixture mounted in the space over the ceiling, the spring members flexibly bearing outwardly against an inner wall of the recessed lighting fixture to hold the trim plate through the reflector insert in position relative to the recessed lighting fixture.

6. The light-transmissive trim plate as recited in claim 4, wherein the partially closed end is configured for engaging a light socket for receiving the light bulb.

* * * * *